US012178318B2

(12) United States Patent
Jeong et al.

(10) Patent No.: US 12,178,318 B2
(45) Date of Patent: Dec. 31, 2024

(54) SHELF AND STORAGE CABINET

(71) Applicants: HEFEI MIDEA REFRIGERATOR CO., LTD., Anhui (CN); HEFEI HUALING CO., LTD., Anhui (CN); MIDEA GROUP CO., LTD., Guangdong (CN)

(72) Inventors: Kyunghan Jeong, Anhui (CN); Shuo Yang, Anhui (CN); Wenji Piao, Anhui (CN); Jinguo Yuan, Anhui (CN); Xiuliang Fu, Anhui (CN)

(73) Assignees: HEFEI MIDEA REFRIGERATOR CO., LTD., Anhui (CN); HEFEI HUALING CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 18/003,080

(22) PCT Filed: Dec. 31, 2021

(86) PCT No.: PCT/CN2021/143772

§ 371 (c)(1),
(2) Date: Dec. 22, 2022

(87) PCT Pub. No.: WO2023/050633

PCT Pub. Date: Apr. 6, 2023

(65) Prior Publication Data

US 2024/0099458 A1 Mar. 28, 2024

(30) Foreign Application Priority Data

Sep. 30, 2021 (CN) ..... 202111161048.7
Sep. 30, 2021 (CN) ..... 202111161068.4
(Continued)

(51) Int. Cl.
*A47B 57/06* (2006.01)

(52) U.S. Cl.
CPC ..... *A47B 57/06* (2013.01)

(58) Field of Classification Search
CPC ..... A47B 57/06; A47B 57/18; A47B 57/30; A47B 96/025; A47F 3/00; A47F 3/0486;
(Continued)

(56) References Cited

U.S. PATENT DOCUMENTS 11,877,654 B1 * 1/2024 Cain ..... B25H 3/06
2008/0079338 A1 * 4/2008 Van Dyke ..... A47B 53/02 312/201
2021/0180855 A1 * 6/2021 Wang ..... F25D 25/04

FOREIGN PATENT DOCUMENTS

CN 106642961 A 5/2017
CN 108562091 A 9/2018
(Continued)

OTHER PUBLICATIONS

CN213605145 English translation and figure (Year: 2021).*
(Continued)

*Primary Examiner* — Janet M Wilkens
(74) *Attorney, Agent, or Firm* — Seed IP Law Group LLP

(57) ABSTRACT

The present application relates to the field of storage machine, and provides a shelf and a storage cabinet. The shelf includes a lifting storage-board assembly, a driving assembly and a transmission assembly. The transmission assembly includes a plate body and a flexible cable, where the plate body is connected to a transmission shaft. The plate body includes an accommodation cavity and an arc groove, where a first end-opening of the arc groove is communicated with the accommodation cavity, and a second end-opening of the arc groove is communicated with an outside of the plate body; and a first end of the flexible cable passes through the arc groove to be fixed in the accommodation cavity, and a second end of the flexible cable is configured to wrap around a mounting portion of the plate body and then connect to the corresponding lifting storage-board assembly.

20 Claims, 6 Drawing Sheets

(30) Foreign Application Priority Data

Sep. 30, 2021 (CN) ..... 202111164204.5
Sep. 30, 2021 (CN) ..... 202111164248.8

(58) Field of Classification Search
CPC ..... F25D 25/04; F25D 25/02; F25D 25/024; F25D 11/00; F25D 2325/021
USPC ..... 312/306, 312, 351, 408; 108/106–108
See application file for complete search history.

(56) References Cited

FOREIGN PATENT DOCUMENTS

| | | | | |
|---|---|---|---|---|
| CN | 109855379 | A | | 6/2019 |
| CN | 212081772 | U | | 12/2020 |
| CN | 112648770 | A | * | 4/2021 |
| CN | 112956846 | A | | 6/2021 |
| CN | 113511607 | A | * | 10/2021 |
| CN | 215951938 | U | * | 3/2022 |
| CN | 117739603 | A | * | 3/2024 |
| CN | 221122737 | U | * | 6/2024 |
| JP | H1085063 | A | | 4/1998 |
| WO | WO 2017036554 | A1 | | 3/2017 |

OTHER PUBLICATIONS

Extended European Search Report dated Nov. 10, 2023, for the corresponding 1 European Patent Application No. 21942140.1, 8 pages.

* cited by examiner

SHELF AND STORAGE CABINET

CROSS-REFERENCE TO RELATED APPLICATIONS

The present application claims priority to Chinese Patent Applications No. 202111164248.8, filed on Sep. 30, 2021, entitled "Shelf and Storage Cabinet", No. 202111161068.4, filed on Sep. 30, 2021, entitled "Shelf and Storage Cabinet", No. 202111161048.7, filed on Sep. 30, 2021, entitled "Shelf and Storage Cabinet", and No. 202111164204.5, filed on Sep. 30, 2021, entitled "Storage Cabinet", which is hereby incorporated by reference in their entity.

FIELD

The present application relates to the field of storage machine, in particular to a shelf and a storage cabinet.

BACKGROUND

In related arts, a shelf in a refrigerator is fixed. When putting food with large volume in it, it is needed to manually adjust a position of the shelf, which is inconvenient to operate and seriously affects user experience. Although some refrigerators have been provided with electric lifting shelves, these electric lifting shelves are not compact enough and occupy a larger space inside the refrigerator, which result in reducing utilization of space inside the refrigerator. In addition, a transmission member of the electric lifting shelf is mostly matched by a rotary table and a wire rope, but a connection between the wire rope and the rotary table often causes the wire rope to break due to wear.

SUMMARY

An objective of the present application is to solve at least one of the problems existing in the related art. The present application provides a shelf, which can make a convolute flexible cable have a smooth transition, improve a load capacity of the convolute flexible cable at the transition section, and prolong a service life of the convolute flexible cable at the transition section, thereby prolonging a service life of a transmission assembly.

The present application further provides a storage cabinet.

The shelf according to an embodiment of the present application includes:

a lifting storage-board assembly;

at least two driving assemblies, where each of the driving assemblies includes a driving member and a transmission shaft connected to the driving member in a transmission manner, and two adjacent transmission shafts are arranged at intervals along a set direction and the two adjacent transmission shafts are staggered; and at least two transmission assemblies, where each of the transmission assemblies includes a plate body and a flexible cable, the plate body is connected to a corresponding transmission shaft, a first end of the flexible cable is connected to the plate body, and a second end of the flexible cable is configured to wrap around a mounting portion of the plate body and then connect to a corresponding lifting storage-board assembly.

According to the shelf provided by the embodiments of the present application, the driving member drives the transmission shaft to swivel and then to lead the lifting storage-board assembly to be lifted and lowered along the set direction through the transmission assembly, so that the shelf can be automatically lifted and lowered without human operation, which improves the user experience. By staggering the two adjacent transmission shafts, the adjacent flexible cables are spaced at a certain distance to avoid friction between the flexible cables, which prolongs the service life of the flexible cable and reduces the cost of use.

According to an embodiment of the present application, lengths of the two adjacent transmission shafts are different, and the driving member is arranged between the two adjacent transmission shafts.

According to an embodiment of the present application, the two adjacent transmission shafts are parallel, and a rotating shaft of the driving member is parallel or perpendicular to the transmission shaft.

According to an embodiment of the present application, the plate body includes an accommodation cavity and an arc groove, where a first end-opening of the arc groove is communicated with the accommodation cavity, and a second end-opening of the arc groove is communicated with an outside of the plate body; and the first end of the flexible cable passes through the arc groove to be fixed in the accommodation cavity, and the second end of the flexible cable is configured to wrap around the mounting portion of the plate body and then connect to the corresponding lifting storage-board assembly.

According to an embodiment of the present application, the plate body is provided with a first through hole in a thickness direction of the plate body, where the first through hole is communicated with the accommodation cavity, and the transmission shaft is inserted into a corresponding first through hole.

According to an embodiment of the present application, the transmission shaft is provided with a limiting member and a locking member, where the limiting member abuts against a first side of a corresponding plate body, and the locking member abuts against a second side of the corresponding plate body.

According to an embodiment of the present application, an end of the transmission shaft is provided with a second through hole, where the locking member is inserted in the second through hole, and the limiting member includes a limiting step arranged provided on the transmission shaft.

According to an embodiment of the present application, an end of the transmission shaft is provided with a clamping groove extending along an axial direction, the accommodation cavity is provided with a clamping member, where the first end of the flexible cable is connected to a corresponding clamping member.

According to an embodiment of the present application, the plate body includes a first plate body and a second plate body which are detachably connected to each other, where the second plate body is arranged at a first side of the first plate body, and the accommodation cavity and the arc groove are arranged at a side of the second plate body facing the first plate body; and the mounting portion includes a groove arranged at a position where an outer surface of the first plate body is connected to an outer surface of the second plate body, or arranged at the outer surface of the second plate body.

According to an embodiment of the present application, the lifting storage-board assembly includes a shelf body and a guiding member, where the guiding member includes a linear guiding rail and a slider, the slider is slidingly matched with a corresponding linear guiding rail and is connected to a second end of a corresponding flexible cable, and the shelf body is connected to the slider.

According to an embodiment of the present application, the guiding member further includes a connecting piece, where the slider is respectively connected to the shelf body and the second end of the corresponding flexible cable through the connecting piece.

According to an embodiment of the present application, the connecting piece is detachably connected to the second end of the corresponding flexible cable.

According to an embodiment of the present application, the connecting piece is provided with a hanging hook, and the hanging hook is hung on the second end of the corresponding flexible cable.

A shelf according to an embodiment of the present application includes:

a lifting storage-board assembly;

a driving assembly, including a driving member and a transmission shaft, where the driving member is connected to the transmission shaft in a transmission manner; and a transmission assembly, including a plate body and a flexible cable, where the plate body is connected to the transmission shaft, the plate body includes an accommodation cavity and an arc groove, a first end-opening of the arc groove is communicated with the accommodation cavity, and a second end-opening of the arc groove is communicated with an outside of the plate body; and a first end of the flexible cable passes through the arc groove to be fixed in the accommodation cavity, and a second end of the flexible cable is configured to wrap around a mounting portion of the plate body and then connect to a corresponding lifting storage-board assembly.

According to an embodiment of the present application, the plate body is provided with a first through hole in a thickness direction of the plate body, where the first through hole is communicated with the accommodation cavity, and the transmission shaft is inserted into a corresponding first through hole.

According to an embodiment of the present application, the transmission shaft is provided with a limiting member and a locking member, where the limiting member abuts against a first side of a corresponding plate body, and the locking member abuts against a second side of the corresponding plate body.

According to an embodiment of the present application, the plate body includes a first plate body and a second plate body which are detachably connected to each other, where the second plate body is arranged at a first side of the first plate body, and the accommodation cavity and the arc groove are arranged at a side of the second plate body facing the first plate body; and the mounting portion includes a groove arranged at a position where an outer surface of the first plate body is connected to an outer surface of the second plate body, or arranged at the outer surface of the second plate body.

According to an embodiment of the present application, a number of the driving assembly is at least two, two adjacent transmission shafts are parallel and arranged at intervals, and a rotating shaft is parallel or perpendicular to the transmission shaft.

According to an embodiment of the present application, lengths of the two adjacent transmission shafts are different, and the driving member is arranged between the two adjacent transmission shafts.

A storage cabinet provided by an embodiment of the present application includes a cabinet body, and further includes any one of the shelves mentioned above, where the shelf is arranged in the cabinet body.

According to an embodiment of the present application, the cabinet body is provided with a wind channel outer-housing, where a mounting position is arranged between the wind channel outer-housing and an inner side wall of the cabinet body, and the transmission assembly is arranged at the mounting position and connected to the lifting storage-board assembly and the driving assembly.

According to an embodiment of the present application, the storage cabinet is a refrigerator, a wine cabinet or a retail cabinet.

One or more of the above solutions in the embodiments of the present application have at least one of the following effects.

According to the shelf provided by the embodiments of the present application, the driving member drives the transmission shaft to swivel and then to lead the lifting storage-board assembly to be lifted and lowered along the set direction through the transmission assembly, so that the shelf can be automatically lifted and lowered without human operation, which improves the user experience. By staggering the two adjacent transmission shafts, the adjacent flexible cables are spaced at a certain distance to avoid friction between the flexible cables, which prolongs the service life of the flexible cable and reduces the cost of use.

According to the storage cabinet provided by the embodiments of the present application, the shelf can be automatically lifted and lowered, which improves the user experience and enhances a competitiveness of a product by using the shelf mentioned above.

Additional aspects and advantages of the present application are set forth, in part, from the following description, and the part will become clear from the following description, or is learned by practice of the present application.

BRIEF DESCRIPTION OF DRAWINGS

In order to more clearly illustrate the solutions according to the present application or the related art, the accompanying drawings used in the description of the embodiments of the present application or the related art will be briefly introduced below. It should be noted that the drawings in the following description are only part embodiments of the present application. For those of ordinary skill in the art, other drawings can also be obtained according to these drawings without creative efforts.

Figure 1:
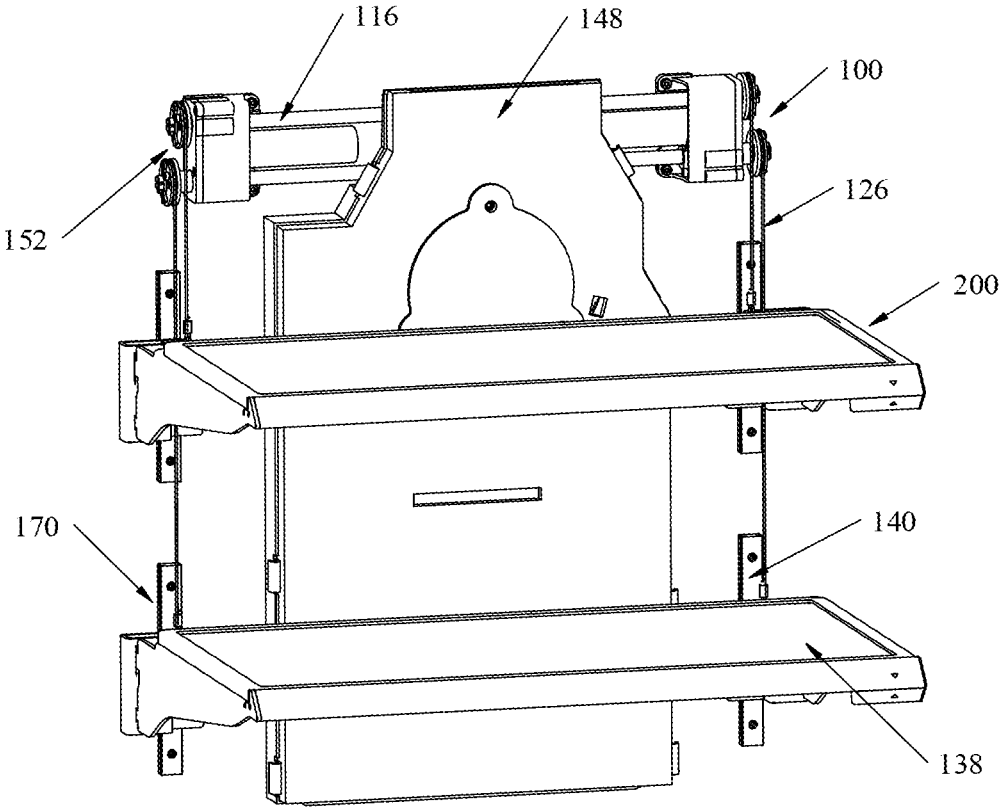
FIG. 1 is a schematic structural diagram of a shelf and a wind channel outer-housing according to an embodiment of the present application.

Reference numerals, 100: driving assembly; 102: plate body; 104: groove; 106: accommodation cavity; 108: arc groove; 110: first through hole; 111: first plate body; 112: second plate body; 114: first collet; 116: transmission shaft; 118: clamping pin; 120: limiting step; 122: clamping groove; 124: mounting opening; 126: flexible cable; 128: second collet; 130: driving member; 132: housing; 134: driving gear; 136: driven gear; 138: shelf body; 140: linear guiding rail; 142: slider; 144: connecting piece; 146: hanging hook; 148: wind channel outer-housing; 150: refrigerator box body; 152: transmission assembly; 154: first end-opening; 156: second end-opening; 158: mounting portion; 160: limiting member; 162: locking member; 164: second through hole; 166: clamping member; 168: transmission member; 170: guiding member; 172: inner side wall; 174: mounting position; 176: rotating shaft; 200: lifting storage-board assembly.

DETAILED DESCRIPTION OF THE EMBODIMENTS

The implementation of the present application is further described in detail below in combination with the accompanying drawings and embodiments. The following embodiments are used to describe the present application, but cannot be used to limit the scope of the present application.

In the description of the present application, it is to be noted that, the orientation or positional relations specified by terms such as "central", "upper", "lower", "front", "back", "left", "right", "top", "bottom", "inner", "outer" and the like, are based on the orientation or positional relations shown in the drawings, which is merely for convenience of description of the present application and to simplify description, but does not indicate or imply that the stated devices or members must have the particular orientation and be constructed and operated in a particular orientation, and thus it is not to be construed as limiting the present application. Furthermore, the terms "first", "second", "third" and the like are only used for descriptive purposes and should not be construed as indicating or implying a relative importance.

In the description of the present application, it is to be noted that unless explicitly specified and defined otherwise, the terms "connected to" and "connected" shall be understood broadly, for example, it may be either fixedly connected or detachably connected, or can be integrated; it may be either mechanically connected, or electrically connected; it may be either directly connected, or indirectly connected through an intermediate medium. The specific meanings of the terms above in the present application can be understood by a person skilled in the art in accordance with specific conditions.

In the embodiments of the present application, unless otherwise expressly specified and defined, a first feature is "on" or "under" a second feature can refer to that the first feature is directly contacted with the second feature, or the first feature is indirectly contacted with the second feature through an intermediate medium. And further, the first feature is "on", "above" and "over" the second feature can refer to that the first feature is directly above or obliquely above the second feature, or simply refer to that the level height of the first feature is higher than that of the second feature. The first feature is "under", "below" and "beneath" the second feature can refer to that the first feature is directly below or obliquely below the second feature, or simply refer to that the level height of the first feature is lower than the level height of the second feature.

In the description of this specification, description with reference to the terms "one embodiment", "some embodiments", "an example", "specific example", "some examples" and the like, refers to that specific features, structures, materials or characteristics described in combination with an embodiment or an example are included in at least one embodiment or example according to the embodiments of the present application. In this specification, schematic representations of the above terms are not necessarily directed to a same embodiment or example. Furthermore, the particular features, structures, materials or characteristics described can be combined in any suitable manner in any one or more embodiments or examples. In addition, those skilled in the art can combine the different embodiments or examples described in this specification, as well as the features of the different embodiments or examples, without conflicting each other.

Figure 2:
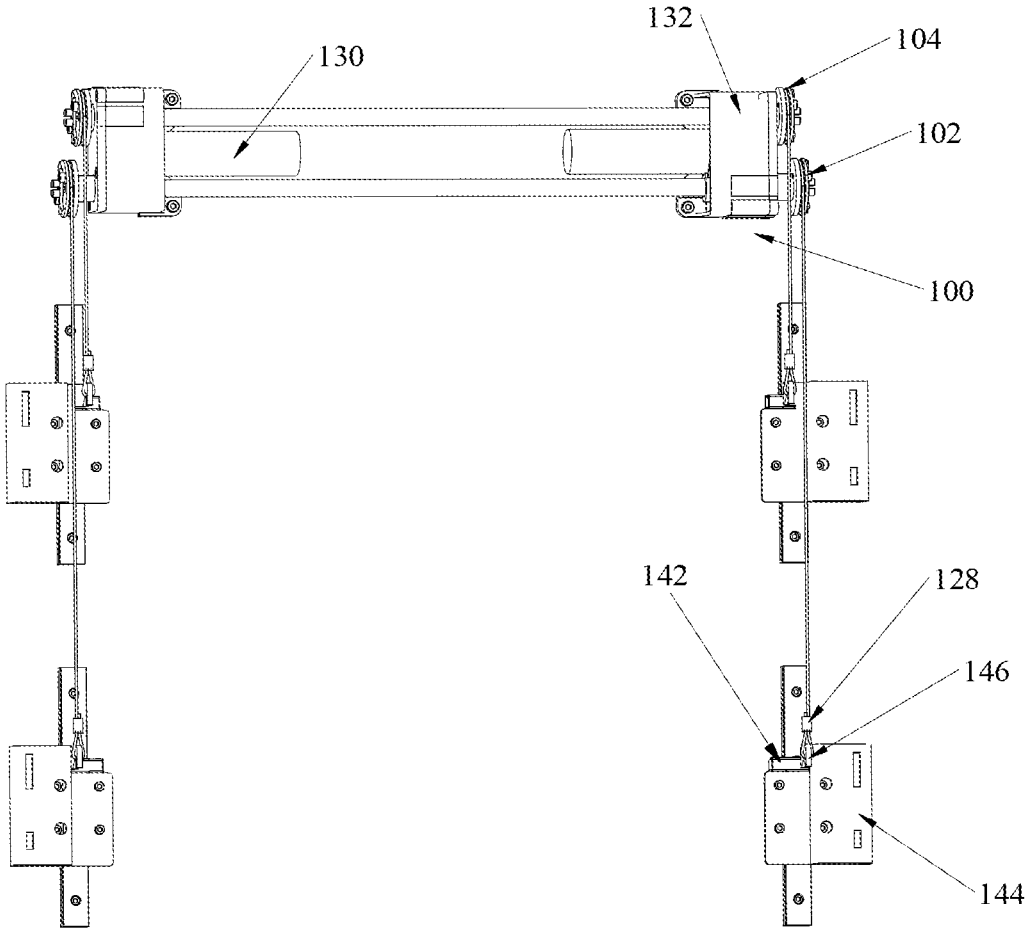
FIG. 2 is a schematic structural diagram of a shelf without a lifting storage-board assembly according to an embodiment of the present application.

FIG. 1 is a schematic structural diagram of a shelf and a wind channel outer-housing 148 provided by an embodiment of the present application. FIG. 2 is a schematic structural diagram of a shelf without a lifting storage-board assembly provided by an embodiment of the present application. As shown in FIG. 1, FIG. 2, FIG. 3 and FIG. 5, the shelf includes a lifting storage-board assembly 200, at least two driving assemblies 100 and at least two transmission assemblies 152. The lifting storage-board assembly 200 can be lifted and lowered along a set direction. The driving assembly 100 includes a driving member 130 and a transmission shaft 116. The transmission shafts 116 of two adjacent driving assemblies 100 are arranged at intervals along a set direction. The driving member 130 is arranged between the two adjacent transmission shafts 116 and is connected to a corresponding transmission shaft 116. The transmission assembly 152 is connected between the transmission shaft 116 and a corresponding lifting storage-board assembly 200. The driving member 130 is configured to drive the lifting storage-board assembly 200 to be lifted and lowered along the set direction through the transmission shaft 116 and the transmission assembly 152.

According to the shelf provided by the embodiments of the present application, the transmission shaft 116 is driven by the driving member 130 to swivel and then to lead the lifting storage-board assembly 200 to be lifted and lowered along the set direction through the transmission assembly 152, so that the shelf can be automatically lifted and lowered without human operation, which improves user experience. By arranging the driving member 130 between the two adjacent transmission shafts 116, the space between the two adjacent transmission shafts 116 is effectively utilized to make the shelf more compact, reduce the occupied space of the shelf, and improve the utilization rate of the space inside the refrigerator.

Figure 3:
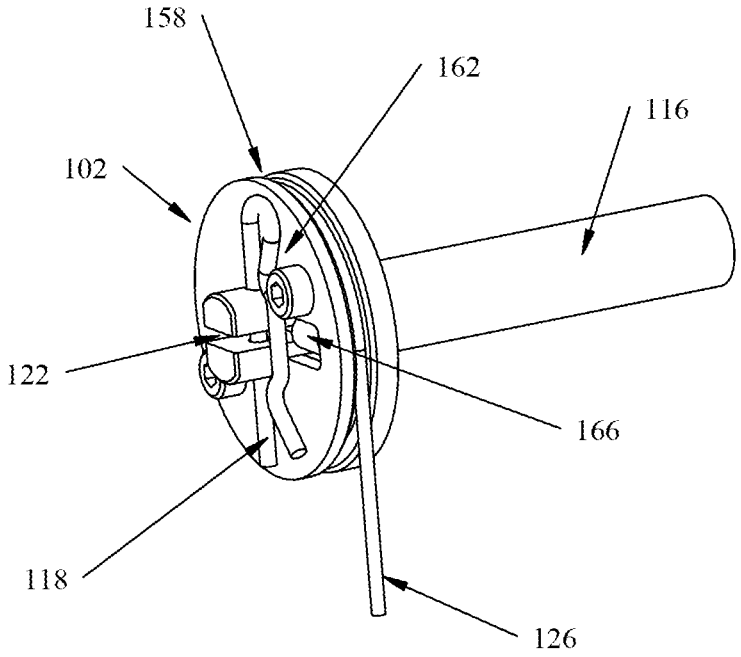
FIG. 3 is a schematic structural diagram of a transmission assembly according to an embodiment of the present application.
Figure 5:
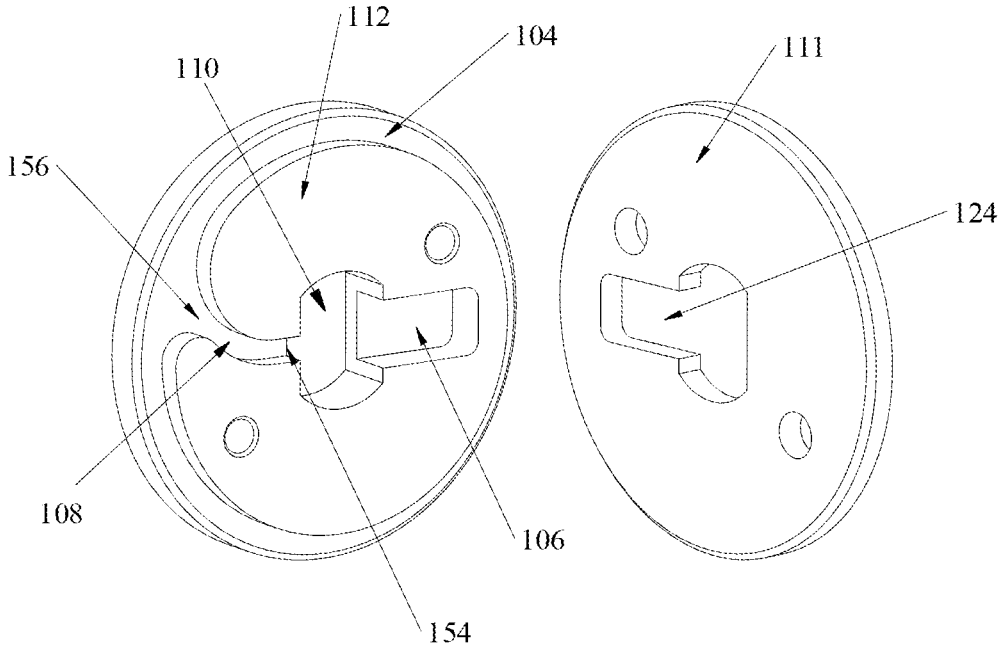
FIG. 5 is a schematic structural diagram of a first plate body and a second plate body according to an embodiment of the present application.

In an embodiment of the present application, FIG. 3 is a schematic structural diagram of a transmission assembly 152 provided by an embodiment of the present application, and FIG. 5 is a schematic structural diagram of a first plate body 111 and a second plate body 112 provided by an embodiment of the present application. As shown in FIG. 3, the transmission assembly 152 includes a plate body 102 and a flexible cable 126, where the plate body 102 includes an accommodation cavity 106 and an arc groove 108, a first end-opening 154 of the arc groove 108 is communicated with the accommodation cavity 106, and a second end-opening 156 of the arc groove 108 is communicated with an outside of the plate body 102. A first end of the flexible cable 126 passes through the arc groove 108 to be fixed in the accommodation cavity 106, and a second end of the flexible cable 126 is configured to wrap around a mounting portion 158 of the plate body 102 and then be connected to the lifting storage-board assembly 200.

The driving assembly 100 drives the plate body 102 to swivel, and then leads the lifting storage-board assembly 200 to be lifted and lowered, thereby the shelf can be automatically lifted and lowered without human operation, which improves the user experience. By providing the arc groove 108 in the plate body 102, the convolute flexible cable 126 can have a smooth transition to avoid the wear and fracture of the flexible cable 126 caused by stress concentration during the flexible cable 126 wraps along the plate body 102, a load capacity of the convolute flexible cable 126 at the transition section is improved, and a service life of the convolute flexible cable 126 at the transition section is prolonged, thereby prolonging a service life of the shelf and improving a reliability of a connection between the flexible cable 126 and the plate body 102.

In an embodiment of the present application, the shelf includes two lifting storage-board assemblies 200, two driving assemblies 100 and four transmission assemblies 152, where the drive assemblies 100 are corresponded one-to-one to the lifting storage-board assemblies 200 and one drive assembly 100 drives one lifting storage-board assembly 200 to be lifted and lowered through two transmission assemblies 152. In a process of controlling two lifting storage-board assemblies 200 to be lifted and lowered, only one of the lifting storage-board assemblies 200 can be controlled to be lifted and lowered, or two lifting storage-board assemblies 200 can be controlled simultaneously to be lifted and lowered.

According to the shelf provided by the embodiments of the present application, the driving member 130 drives the transmission shaft 116 to swivel and then to lead the lifting storage-board assembly 200 to be lifted and lowered along the set direction through the transmission assembly 152, so that the shelf can be automatically lifted and lowered without human operation, which improves the user experience. By staggering the adjacent two transmission shafts 116, the adjacent flexible cables 126 are spaced at a certain distance to avoid friction between the flexible cables 126, which prolongs the service life of the flexible cable 126 and reduces the cost of use.

It should be noted that numbers of lifting storage-board assemblies 200 and driving assemblies 100 are not limited to two but can be three or more. The number of transmission assemblies 152 is twice the number of driving assemblies 100.

In an embodiment of the present application, the shelf includes two driving assemblies 100, and transmission shafts 116 of the two driving assemblies 100 are horizontal and arranged at intervals. Two ends of the transmission shaft 116 are detachably connected to the corresponding plate body 102 respectively. The transmission shaft 116 plays a role of connection between the two plate bodies 102. By connecting two plate bodies 102 through the transmission shaft 116, only one driving assembly 100 is needed to drive the two plate bodies 102 to swivel synchronously, which reduces the number of members of the driving assembly 100, simplifies the structure of the driving assembly 100, and reduces the production cost. Detachable connection between the transmission shaft 116 and the plate body 102 facilitates assembly and disassembly of the driving assembly 100 and maintenance of damaged members.

In an embodiment of the present application, the flexible cable 126 is a wire rope which has a large load capacity to ensure that the shelf can bear heavier object. The flexible cable 126 can also be a rope, a wire or a chain, etc. The mounting portion 158 includes a groove 104 provided on an outer surface of the plate body 102. A side wall of the groove 104 is used to limit the flexible cable 126, ensuring that the flexible cable 126 can automatically wind around in the groove 104 when the plate body 102 swivels in the positive direction.

In an embodiment of the present application, as shown in FIG. 5, the plate body 102 is provided with a first through hole 110 arranged in a thickness direction of the plate body 102, where the first through hole 110 is connected to the accommodation cavity 106, and two ends of the transmission shaft 116 are inserted into corresponding first through holes 110 respectively. The plate body 102 is a annular plate body 102, and a center of the first through hole 110 coincides with a center of the plate body 102.

In an embodiment of the present application, both ends of the transmission shaft 116 are provided with a limiting member 160 and a locking member 162, where the limiting member 160 abuts against a first side of a corresponding plate body 102, and the locking member 162 abuts against the second side of the corresponding plate body 102. Since the plate body 102 is arranged between the limiting member 160 and the locking member 162, a combination of the limiting member 160 and the locking member 162 can connect the plate body 102 to two ends of the transmission shaft 116 to prevent the plate body 102 from moving along an axial direction of the transmission shaft 116. By limiting the plate body 102 using the locking member 162, the assembly and disassembly steps of the plate body 102 can be simplified.

In an embodiment of the present application, two ends of the transmission shaft 116 are respectively provided with a second through hole 164, where the locking member 162 is inserted into a corresponding second through hole 164, and the limiting member 160 includes a limiting step 120 provided on the transmission shaft 116. Each of the two ends of the transmission shaft 116 is provided with two limiting steps 120, and the two limiting steps 120 are symmetrically arranged. By providing the limiting step 120, it is not needed to provide other limiting members 160, which reduces a number of members of the shelf and simplifies the structure of the shelf.

In an embodiment, by milling at least one plane on peripheral surfaces at two ends of the transmission shaft 116, limiting steps 120 are formed on the peripheral surfaces at two ends of the transmission shaft 116.

In an embodiment of the present application, as shown in FIG. 3, the locking part 162 includes a clamping pin 118. After the clamping pin 118 is inserted into the second through hole 164, a clamping portion of the clamping pin 118 clamps an end of the corresponding transmission shaft 116, which not only locks the plate body 102, but also locks the clamping pin 118, thereby preventing the clamping pin 118 from falling off during a swivel of the plate body 102. In addition, the clamping pin 118 can facilitate the assembly and disassembly of the plate body 102.

In an embodiment of the present application, the locking member 162 includes a pin nail. After the pin nail is inserted into the second through hole 164, an opening end of the pin nail needs to be bent to prevent the pin nail from falling off during the swivel of the plate body 102.

In an embodiment of the present application, an edge of the first through hole 110 is provided with a key groove, and the locking member 162 includes a key pin. By inserting the key pin in the key groove, the plate body 102 can be connected to the transmission shaft 116.

In an embodiment the present application, the two ends of the transmission shaft 116 are provided with threads, and the locking part 162 includes a nut. Two nuts are connected to the two ends of the transmission shaft 116 respectively. It should be noted that the specific type of locking member 162 can be other form and is not limited to clamping pin 118, pin nail or nut.

In an embodiment of the present application, the limiting member 160 includes a clamping spring. The two ends of the transmission shaft 116 are provided with an annular groove respectively. The annular groove is arranged at a first side of the plate body 102, and the clamping spring is stuck in the annular groove, thereby limiting the plate body 102.

In an embodiment of the present application, the limiting member 160 includes a limiting ring. The two ends of the transmission shaft 116 are respectively provided with a limiting ring. The limiting ring is integrated with the transmission shaft 116. The limiting ring is arranged at a first side of the plate body 102 and plays a limiting role for the plate body 102.

It should be noted that the specific type of limiting member 160 is not limited to the clamping spring, limiting ring and limiting step 120, but can also be other types.

In an embodiment of the present application, the first through hole 110 is a swivel-stopping hole, and a cross-sectional shape of each of the two ends of the transmission shaft 116 is matched with the shape of the first through hole 110. The first through hole 110 is set as swivel-stopping hole, and the transmission shaft 116 is inserted into the first through hole 110 to prevent a relative motion of the plate body 102 and the transmission shaft 116.

It should be noted that the swivel-stopping hole can be a waist shaped hole, a rectangular hole, a regular polygon hole, a triangular hole or other non-circular holes with other shapes.

In an embodiment of the present application, both ends of the transmission shaft 116 are provided with a clamping groove 122 extending in an axial direction, the accommodation cavity 106 is provided with a clamping member 166 therein, and the first end of the flexible cable 126 passes through the corresponding clamping groove 122 and is connected to a corresponding clamping member 166. The clamping groove 122 can not only allow the first end of the flexible cable 126 to pass through, but also limit the clamping member 166, so that the first end of the flexible cable 126 is connected in the accommodation cavity 106. By limiting the clamping member 166 using the clamping groove 122, the clamping member 166 can be fixed without providing other members, which reduces a number of members and simplifies the structure of the transmission assembly 152.

Figure 4:
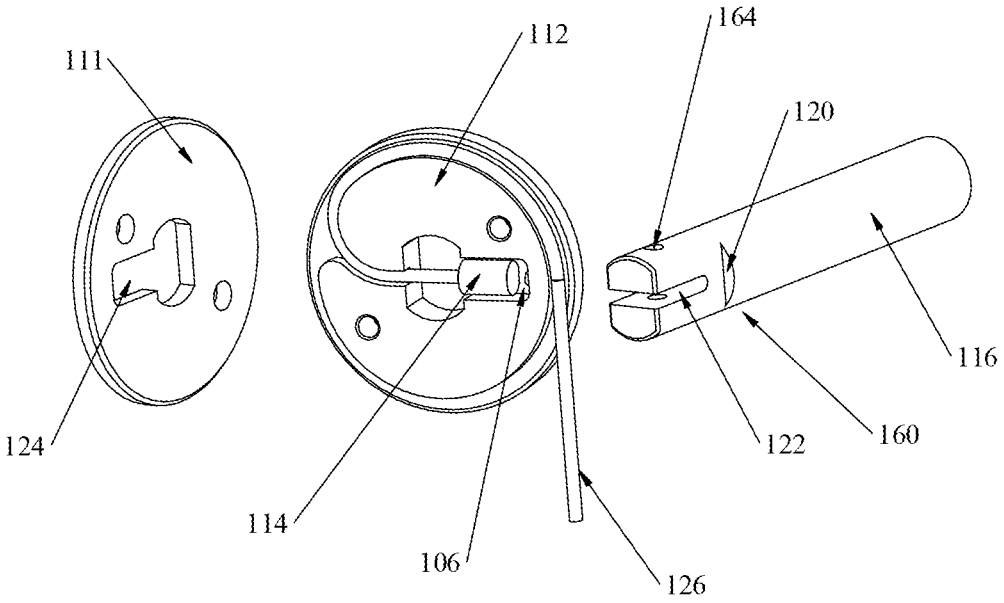
FIG. 4 is a schematic exploded structural diagram of a transmission assembly according to an embodiment of the present application.

In an embodiment of the present application, FIG. 4 is a schematic exploded structural diagram of a transmission assembly provided by an embodiment of the present application. As shown in FIG. 4, the clamping member 166 includes a first collet 114, where a width of the first collet 114 is greater than a width of the clamping groove 122. Since the width of the first collet 114 is greater than a width of an opening of the clamping groove 122, the first collet 114 cannot pass through the clamping groove 122, thereby can fix the first end of the flexible cable 126. By connecting the plate body 102 and the flexible cable 126 using the first collet 114, a connection between the plate body 102 and the flexible cable 126 is safe and reliable.

It should be noted that the method of fixing the first end of the flexible cable 126 is not limited to the above. For example, a limiting groove can be provided in the accommodation cavity 106, where a width of the limiting groove is less than the width of the first collet 114 and the first end of the flexible cable 126 can be clamped into the limiting groove to fix the first end of the flexible cable 126.

In an embodiment of the present application, as shown in FIG. 5, the plate body 102 includes a first plate body 111 and a second plate body 112. Both the first plate body 111 and the second plate body 112 are annular plate body 102, and a diameter of the first plate body 111 is equal to a diameter of the second plate body 112. The second plate body 112 is arranged at a first side of the first plate body 111, and the accommodation cavity 106 and the arc groove 108 are arranged at a side of the second plate body 112 facing the first plate body 111. The mounting portion 158 includes a groove 104 which is arranged at a connection position of a peripheral surface of the first plate body 111 and a peripheral surface of the second plate body 112. At this time, the peripheral surface of the first plate body 111 is a first sloping surface inclined to the second plate body 112, the peripheral surface of the second plate body 112 is a second sloping surface inclined to the first plate body 111, and the first sloping surface cooperates with the second sloping surface to form the groove 104. In other embodiments, the groove 104 can be arranged only at the peripheral surface of the second plate body 112.

In an embodiment of the present application, the first plate body 111 is provided with a mounting opening 124, and the mounting opening 124 is connected to the accommodation cavity 106. A size of the mounting opening 124 is matched with a size of the first collet 114 to ensure that the first collet 114 can pass through the mounting opening 124 and then can facilitate mounting the transmission assembly 152.

In an embodiment of the present application, the first plate body 111 and the second plate body 112 are connected by screws to facilitate the assembly and disassembly of the first plate body 111 and the second plate body 112. It should be noted that, the connection mode between the first plate body 111 and the second plate body 112 is not limited to this. For example, one of the first plate body 111 and the second plate body 112 is provided with a clamping tab and another of the first plate body 111 and the second plate body 112 is provided with clamping hole, and by inserting the clamping tab in the clamping hole, a detachable connection between the first plate body 111 and the second plate body 112 is realized.

Figure 6:
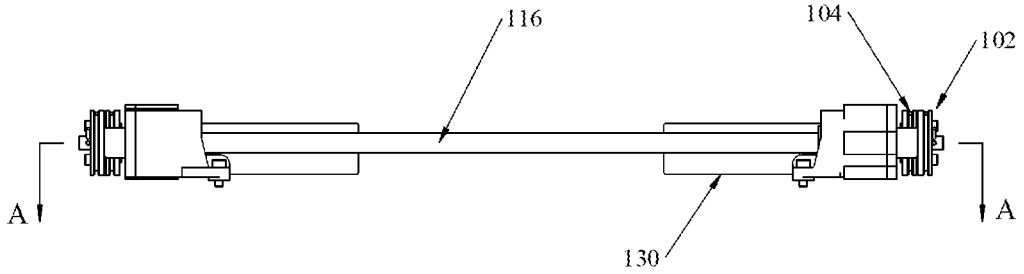
FIG. 6 is a schematic top view of a driving assembly according to an embodiment of the present application.
Figure 7:
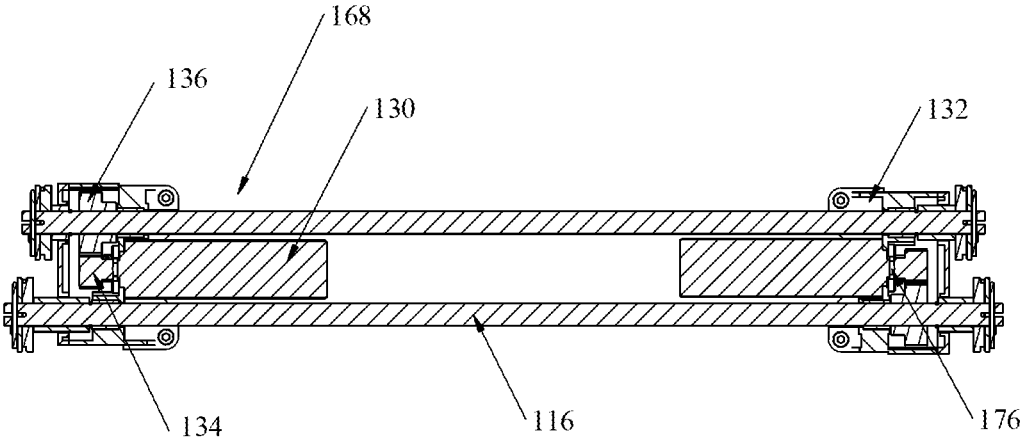
FIG. 7 is a schematic sectional diagram of FIG. 6 in A-A direction.
Figure 8:
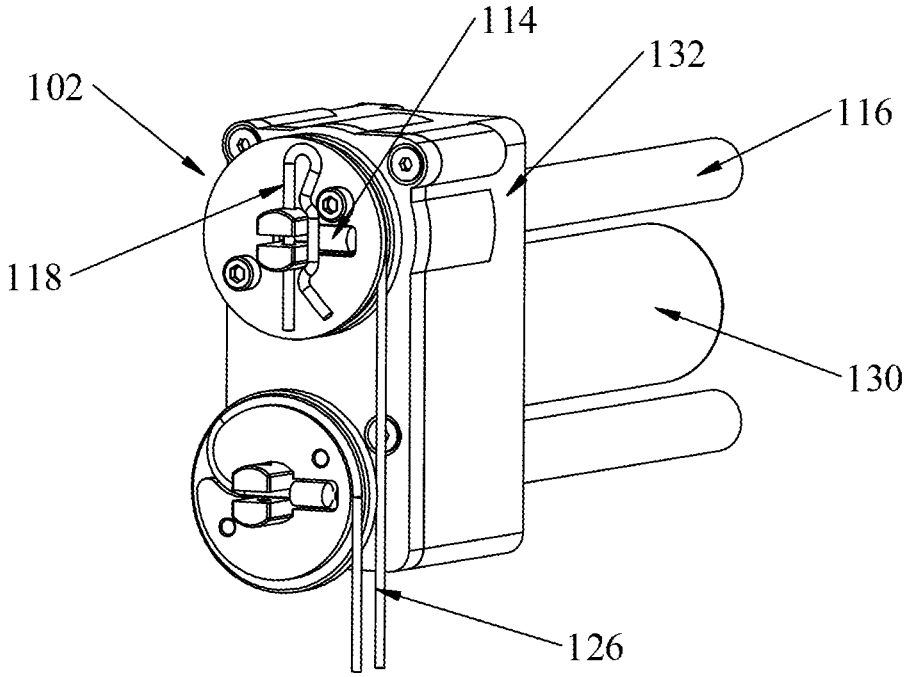
FIG. 8 is a schematic connecting relation diagram of a driving assembly and a transmission assembly according to an embodiment of the present application.
Figure 9:
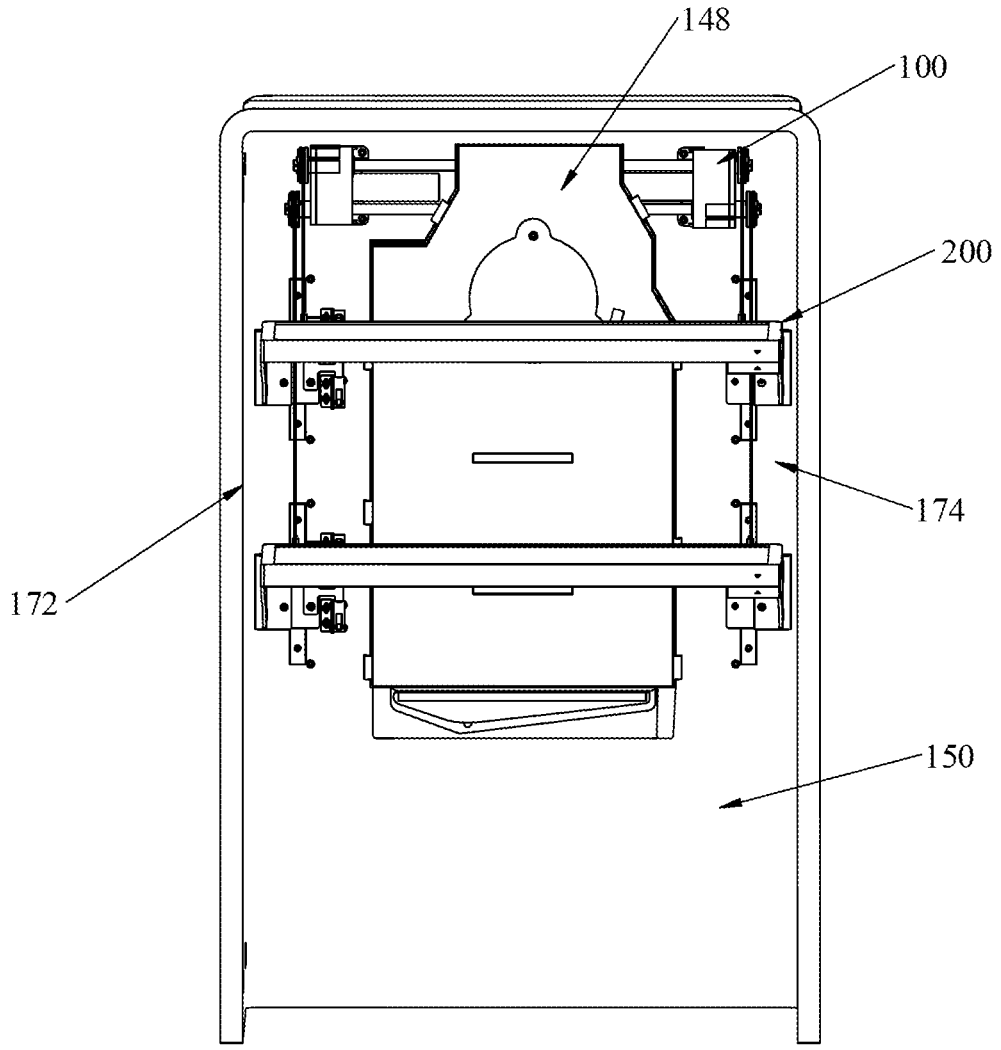
FIG. 9 is a schematic structural diagram of a shelf applied to a refrigerator according to an embodiment of the present application.

In the embodiments of the present application, FIG. 6 is a schematic top view of a driving assembly 100 provided by an embodiment of the present application, FIG. 7 is a schematic sectional diagram of FIG. 6 in A-A direction, and FIG. 8 is a schematic connecting relation diagram of a driving assembly 100 and a transmission assembly 152 provided by an embodiment of the present application. As shown in FIG. 6, FIG. 7 and FIG. 9, the shelf includes two driving assemblies 100, namely a first driving assembly 100 and a second driving assembly 100. The transmission shaft 116 of the first driving assembly 100 is denoted as a first transmission shaft 116, and the transmission shaft 116 of the second driving assembly 100 is denoted as a second transmission shaft 116. The first transmission shaft 116 and the second transmission shaft 116 are parallel and are arranged at intervals. The first transmission shaft 116 is arranged above the second transmission shaft 116, and there is a certain space between the first transmission shaft 116 and the second transmission shaft 116 to mount the driving member 130. A length of the first transmission shaft 116 is less than a length of the second transmission shaft 116, so that the plate bodies 102 at two ends of the first transmission shaft 116 and the plate bodies 102 at two ends of the second transmission shaft 116 are staggered to avoid mutual interference between the flexible cable 126 of the first driving assembly 100 and the flexible cable 126 of the second driving assembly 100.

In an embodiment, the driving assembly 100 includes a driving member 130, a transmission shaft 116, a housing 132 and a transmission member 168 in the housing 132. A rotating shaft 176 of the driving member 130 is connected to an end of a corresponding transmission shaft 116 through the transmission member 168. One end of the transmission shaft 116 matches with the housing 132 rotatably, and another end of the transmission shaft 116 matches with the housing 132 of another driving assembly 100. In order to improve the stability of the transmission shaft 116 when the transmission shaft 116 is swiveling, the housing 132 is provided with a shaft bearing therein, where the shaft bearing is sleeved on an outer surface of the transmission shaft 116, and the transmission shaft 116 matches with the housing 132 rotatably through the shaft bearing. By connecting the two transmission shafts 116 through the housing 132, an integrated design layout of the two driving assemblies 100 can be reached, which simplifies a structure of the driving assembly 100, facilitates the assembly and disassembly, improves the compactness of the shelf, reduces the occupied space of the shelf, and can effectively utilize the limited space around the wind channel outer-housing 148 in the refrigerator. The transmission member 168 is configured to reduce a swivel speed of the transmission shaft 116, increase a torque of the transmission shaft 116, thereby increasing the load capacity of the driving assembly 100.

In an embodiment of the present application, the driving member 130 is arranged between the transmission shafts 116 of two drive assemblies 100 and an axis of the rotating shaft 176 of the driving member 130 is parallel to axes of the transmission shafts 116. The outside housing of the driving member 130 is connected to the housing 132, and the driving member 130 is fixed between the transmission shafts 116 of the two driving assemblies 100, which can further improve the compactness of the shelf, reduce the occupied space of the shelf, and effectively utilize the limited space around the wind channel outer-housing 148 in the refrigerator.

In an embodiment, the driving member 130 can be a motor or a motor with a reducer. The axis of the rotating shaft 176 of the driving member 130 can be perpendicular to the axes of the transmission shafts 116. The driving member 130 and the transmission shaft 116 can be connected by a pair of bevel gears.

In an embodiment of the present application, the transmission member 168 includes a driving gear 134 and a driven gear 136, where the driving gear 134 is connected to the rotating shaft 176 of the driving member 130, the driven gear 136 is connected to one end of the transmission shaft 116, and the driving gear 134 is engaged with the driven gear 136. By using gear assembly for transmission, the stability and reliability of transmission between the driving member 130 and the transmission shaft 116 are improved, and the transmission efficiency and the bearing capacity of the transmission member 168 are also improved.

It should be noted that the number of gears of the transmission member 168 is not limited to two, but a plurality of gears can be arranged between the driving gear 134 and the driven gear 136 for transmission. The number of gears is determined based on the speed difference between the driving member 130 and transmission shaft 116.

In an embodiment of the present application, the transmission member 168 includes a driving belt wheel, a driven belt wheel and a belt. The driving belt wheel is connected to the rotation shaft 176 of the driving member 130, and the driven belt wheel is connected to one end of the transmission shaft 116. The driving belt wheel is connected to the driven belt wheel through the belt. An outer diameter of the driving belt wheel is smaller than an outer diameter of the driven belt wheel.

In an embodiment of the present application, the lifting storage-board assembly 200 includes a shelf body 138 and a guiding member 170. The guiding member 170 includes two linear guiding rails 140 and two sliders 142. The two linear guiding rails 140 are arranged in parallel and at intervals. When the shelf is used in a refrigerator, the two linear guiding rails 140 are arranged at both sides of the wind channel outer-housing 148, and the two linear guiding rails 140 are symmetrical in the left and right direction. The two sliders 142 slidingly match with corresponding linear guiding rails 140 respectively, the slider 142 is connected to a second end of a corresponding flexible cable 126, and two ends of the shelf body 138 are connected to the two sliders 142 one-to-one by bolts. The shelf body 138 is guided by the two linear guiding rails 140 and two sliders 142, so that the shelf body 138 can only move in a preset direction. Two sliders 142 are driven by flexible cables 126 to move together to ensure that the shelf can be lifted and lowered smoothly and reliably under deviated load, the anti-deviation ability of the shelf body 138 can be effectively improved and the stability of the shelf body 138 during movement can be effectively improved.

It should be noted that only one shelf body 138 is arranged between the two sliders 142 in this embodiment, that is, a lifting storage-board assembly 200 includes one shelf body 138. A lifting storage-board assemblies 200 can also include two or more shelf bodies 138, where a distance between the shelf bodies 138 of the same lifting storage-board assemblies 200 is fixed, and when one of the shelf bodies 138 moves, the other shelf bodies 138 of the same lifting storage-board assemblies 200 also moves. The number of linear guiding rail 140 is not limited to two, but can only be one.

In an embodiment of the present application, the guiding member 170 further includes a connecting piece 144. The connecting piece 144 is connected to the slider 142 by bolts, two ends of the shelf body 138 are connected to corresponding connecting piece 144 by bolts, and the connecting piece 144 is connected to a second end of a corresponding flexible cable 126. By connecting the shelf body 138 and the slider 142 using the flexible cable 126, the assembly and disassembly of the shelf body 138 are convenient.

In an embodiment of the present application, the connecting piece 144 is detachably connected to the second end of the corresponding flexible cable 126, which can facilitate the assembly and disassembly of the shelf and facilitate the replacement of damaged flexible cable 126.

In an embodiment of the present application, the connecting piece 144 is provided with a hanging hook 146, and the second end of the flexible cable 126 is provided with a hanging ring which is fixed by a second collet 128, where the hanging hook 146 is hung on the hanging ring, so that the hanging hook 146 is hung on the second end of the corresponding flexible cable 126. Compared to other connection modes, by hanging the hanging hook 146 on the hanging ring, the assembly and disassembly of the shelf is much easier and the user experience is enhanced.

In an embodiment of the present application, as shown in FIG. 1 and FIG. 2, the shelf includes two lifting storage-board assemblies 200, two driving assemblies 100 and four transmission assemblies 152. The driving assembly 100 includes a driving member 130, a transmission shaft 116, a housing 132 and a transmission member 168 provided in the housing 132. A rotating shaft 176 of the driving member 130 is connected to one end of a corresponding transmission shaft 116 through the transmission member 168. One end of the transmission shaft 116 rotatably matches with the housing 132 through shaft bearing, and another end of the transmission shaft 116 rotatably matches with the housing 132 of another driving assembly 100 through shaft bearing.

The two driving assemblies 100 include a first driving assembly 100 and a second driving assembly 100. The first transmission shaft 116 of the first driving assembly 100 and the second transmission shaft 116 of the second driving assembly 100 are parallel and are arranged at intervals. The first transmission shaft 116 is arranged above the second transmission shaft 116, and a mounting space is arranged between the first transmission shaft 116 and the second transmission shaft 116. The length of the first transmission shaft 116 is less than the length of the second transmission shaft 116, so that the plate bodies 102 at both ends of the first transmission shaft 116 and the plate bodies 102 at both ends of the second transmission shaft 116 are staggered to avoid the mutual interference between the flexible cable 126 corresponding to the first driving assembly 100 and the flexible cable 126 corresponding to the second driving assembly 100.

The driving member 130 is arranged between the first transmission shaft 116 and the second transmission shaft 116, the outer housing of the driving member 130 is connected to the housing 132, and the axis of the rotation shaft 176 of the driving member 130 is parallel to the axes of the transmission shafts 116. Transmission member 168 includes driving gear 134 and driven gear 136, where the driving gear 134 is connected to the rotating shaft 176 of the driving member 130, the driven gear 136 is connected to one end of transmission shaft 116, and the driving gear 134 is engaged with the driven gear 136.

Each driving assembly 100 corresponds to two driving assemblies 152 which are arranged at intervals and arranged at both sides of the wind channel outer-housing 148. The transmission assembly 152 includes the plate body 102 and the flexible cable 126. The plate body 102 includes the first plate body 111 and the second plate body 112. The first plate body 111 and the second plate body 112 are both annular plate body 102, and the diameter of the first plate body 111 is equal to the diameter of the second plate body 112. The second plate body 112 is arranged at the first side of the first plate body 111, and the first plate body 111 and the second plate body 112 are connected by screws. The mounting portion 158 includes the groove 104 which is used to accommodate the flexible cable 126, where the groove 104 is arranged at a position where the outer surface of the first plate body 111 is connected to the outer surface of the second plate body 112. At this time, the peripheral surface of the first plate body 111 is a first sloping surface inclined to the second plate body 112, and the peripheral surface of the second plate body 112 is a second sloping surface inclined to the first plate body 111. The first sloping surface cooperates with the second sloping surface to form the groove 104.

The accommodation cavity 106 and the arc groove 108 are arranged at the side of the second plate body 112 facing the first plate body 111. The first end-opening 154 of the arc groove 108 is communicated with the accommodation cavity 106, and the second end-opening 156 of the arc groove 108 is communicated with the arc groove 108. The first end of the flexible cable 126 passes through the arc groove 108 to be connected to the first collet 114 in the accommodation cavity 106, and the second end of the flexible cable 126 is configured to connect to the lifting storage-board assembly 200 after wrapping around the mounting portion 158 of the plate body 102. The plate body 102 is provided with the first through hole 110 in the thickness direction of the plate body 102, where the first through-hole 110 passes through the first plate body 111 and the second plate body 112 and communicates with the accommodation cavity 106, and the two ends of the transmission shaft 116 are inserted into the corresponding first through hole 110. The first through hole 110 is swivel-stopping hole, and the cross-sectional shapes of both ends of the transmission shaft 116 are matched with the shape of the first through hole 110. The first plate body 111 is provided with a mounting opening 124 which is connected to the accommodation cavity 106. The size of the mounting opening 124 is matched with the size of the first collet 114 to ensure that the first collet 114 can pass through the mounting opening 124.

Both ends of the transmission shaft 116 are provided with a limiting member 160 and a locking member 162. The limiting member 160 abuts against the first side of the corresponding plate body 102, and the locking member 162 abuts against the second side of the corresponding plate body 102. The two ends of the transmission shaft 116 are respectively provided with the second through hole 164, and the locking member 162 includes the clamping pin 118. After the clamping pin 118 is inserted in the second through hole 164, the clamping portion of the clamping pin 118 clamps one end of the corresponding transmission shaft 116. The limiting member 160 includes a limiting step 120 provided on the transmission shaft 116. Any end of the transmission shaft 116 is provided with two limiting steps 120, and the two limiting steps 120 are symmetrically arranged.

Both ends of the transmission shaft 116 are provided with a clamping groove 122 extending in the axial direction, the accommodation cavity 106 is provided with a first collet 114 therein, and the first end of the flexible cable 126 passes through the corresponding clamping groove 122 and then connects to the corresponding first collet 114. The width of the first collet 114 is larger than the width of the clamping groove 122. The clamping groove 122 can not only allow the first end of the flexible cable 126 to pass through, but also limit the first collet 114, so that the first end of the flexible cable 126 is connected in the accommodation cavity 106. And by limiting the clamping member 166 using the clamping groove 122, the clamping member 166 can be fixed without providing other members, which reduces the number of members and simplifies the structure of the transmission assembly 152.

The lifting storage-board assembly 200 includes a shelf body 138 and a guiding member 170. The guiding member 170 includes two linear guiding rails 140, two sliders 142 and two connecting pieces 144. The two linear guiding rails 140 are arranged in parallel and at intervals. When the shelf is used in a refrigerator, two linear guiding rails 140 are vertically arranged inside the refrigerator, and the two linear guiding rails 140 are arranged at both sides of the wind channel outer-housing 148. The two sliders 142 slidingly match with corresponding linear guiding rails 140 respectively, the two connecting pieces 144 are connected to the corresponding slider 142 by bolts, and the two ends of the shelf body 138 are connected to the two connecting pieces 144 one-to-one by bolts. The connecting piece 144 is provided with a hanging hook 146, and the second end of the flexible cable 126 is provided with a hanging ring. The hanging ring is fixed by the second collet 128, and the hanging hook 146 is hung on the hanging ring, so that the hanging hook 146 is hung on the second end of the corresponding flexible cable 126.

When the driving member 130 drives the driving gear 134 to swivel, the driving gear 134 leads the driven gear 136 to swivel, the driven gear 136 leads the transmission shaft 116 to swivel, and the transmission shaft 116 leads the two plated bodies 102 to swivel synchronously, and then the two plated bodies 102 lead the shelf body 138 to be lifted and lowered along the linear guiding rail 140 through two flexible cables 126 to change the height of the shelf body 138 to meet the needs of placing food at different heights. Since there is no need for human operation, the user experience is improved, and the product competitiveness is enhanced.

An embodiment of the present application provides a storage cabinet, including a cabinet body, and further includes the shelf mentioned in any of the above embodiments, where the self is arranged in the cabinet body.

In an embodiment of the present application, FIG. 9 is a schematic structural diagram of a shelf applied to a refrigerator provided by an embodiment of the present application. As shown in FIG. 9, the storage cabinet is a refrigerator, and the shelf is arranged on a refrigerator box body 150 in the cabinet body. The two linear guiding rails 140 of the same lifting storage-board assembly 200 are arranged at both sides of the wind channel outer-housing 148 to effectively utilize the limited space around the wind channel outer-housing 148 in the refrigerator. The specific type of the storage cabinet is not limited to this, but the storage cabinet can be a freezer or other storage cabinet.

The storage cabinet according to the embodiments of the present application, by using the above shelf, the shelf body 138 can be automatically lifted and lowered to improve the user experience and enhance the competitiveness of the product.

According to an embodiment of the present application, the cabinet body is provided with the wind channel outer-housing 148 therein. A mounting position 174 is provided between the wind channel outer-housing 148 and the inner side wall 172 of the cabinet body, and the transmission assembly 152 is arranged at the mounting position 174 and connected to the lifting storage-board assembly 200 and the driving assembly 100.

By arranging the transmission assembly 152 in the gap between the wind channel outer-housing 148 and the inner side wall 172 of the cabinet body, where the gap is the mounting position 174 used for accommodating the transmission assembly 152, the transmission assembly 152 does not occupy the actual storage space in the cabinet body, and it facilitates maintaining the regularity and integrity of the storage space and improves the convenience of storage.

According to an embodiment of the present application, it further includes a guiding member. The guiding member is arranged at the mounting position 174, the guiding member is slidably provided with a slider 142, and the lifting storage-board assembly 200 is connected to the slider 142.

The guiding member can include two linear guiding rail 140, and correspondingly, the number of sliders 142 is two. The two linear guiding rails 140 are parallel and arranged at intervals. When the shelf is used in the interior of the refrigerator, the two linear guiding rails 140 are arranged at both sides of the wind channel outer-housing 148 respectively, and the two linear guiding rails 140 are symmetrical in the left and right direction. The two sliders 142 slidingly match with corresponding linear guiding rails 140 respectively. The slider 142 can be connected to the second end of the corresponding flexible cable 126. The two ends of the shelf assembly are connected to the two sliders 142 one-to-one by bolts. The shelf assembly is guided by two linear guiding rails 140 and two sliders 142, so that the shelf assembly can only move in a preset direction. Two sliders 142 are driven by flexible cables 126 to move together to ensure that the shelf can be lifted and lowered smoothly and reliably under deviated load, the anti-deviation ability of the shelf body 138 can be effectively improved and the stability of the shelf body 138 during movement can be effectively improved.

It should be noted that the number of linear guiding rails 140 is not limited to two, but can be only one.

According to an embodiment of the present application, the storage cabinet can be a refrigerator, a wine cabinet or a retail cabinet.

Finally, it should be noted that the above embodiments are only used to illustrate the solutions of the present application, rather than limiting the solutions. Although the present application is described in detail with reference to the above embodiments, those of ordinary skill in the art should understand that: they can still modify the solutions recorded in the above embodiments, or make equivalent replacements to some of the features; these modifications or replacements do not make the essence of the corresponding solutions depart from the scope of the solutions of various embodiments of the present application.

The above embodiments are only used to illustrate the solutions of the present application, rather than limiting the solutions. Although the present application is described in detail with reference to the above embodiments, those of ordinary skill in the art should understand that the various combinations, modifications or equivalent replacements of the solutions of the present application are not divorced from the scope of the solutions of the present application, and should be covered in the scope of the claims of the present application.

What is claimed is:

1. A shelf, comprising:

a lifting storage-board assembly;

at least two driving assemblies, wherein each of the at least two driving assemblies comprises a driving member and a transmission shaft connected to the driving member in a transmission manner, and two adjacent transmission shafts are arranged at an interval along a set direction and the two adjacent transmission shafts are staggered; and at least two transmission assemblies, wherein each of the transmission assemblies comprises a plate body and a flexible cable, the plate body is connected to a corresponding transmission shaft, a first end of the flexible cable is connected to the plate body, and a second end of the flexible cable is configured to wrap around a mounting portion of the plate body and then connect to a the lifting storage-board assembly, wherein:

a plate body of a transmission assembly of the at least two transmission assemblies comprises an accommodation cavity and an arc groove, a first end-opening of the arc groove is in communication with the accommodation cavity, and a second end-opening of the arc groove is in communication with an outside of the plate body, and the first end of the flexible cable of the transmission assembly passes through the arc groove to be fixed in the accommodation cavity, and the second end of the flexible cable is configured to wrap around the mounting portion of the plate body and then connect to the lifting storage-board assembly, and an end of a transmission shaft of a driving assembly of the at least two driving assemblies is provided with a clamping groove extending along an axial direction, the accommodation cavity is provided with a clamping member, and the first end of the flexible cable is connected to a corresponding clamping member.

2. The shelf according to claim 1, wherein lengths of the two adjacent transmission shafts are different, and a driving member of a driving assembly of the at least two driving assemblies is arranged between the two adjacent transmission shafts.

3. The shelf according to claim 1, wherein the two adjacent transmission shafts are parallel to one another, and a rotating shaft of a driving member of a driving assembly of the at least two driving assemblies is parallel or perpendicular to a transmission shaft of the driving assembly.

4. The shelf according to claim 1, wherein the plate body is provided with a first through hole in a thickness direction of the plate body, the first through hole is in communication with the accommodation cavity, and the transmission shaft is inserted into a corresponding first through hole.

5. The shelf according to claim 1, wherein a transmission shaft of a driving assembly of the at least two driving assemblies is provided with a limiting member and a locking member, the limiting member abuts against a first side of a corresponding plate body, and the locking member abuts against a second side of the corresponding plate body.

6. The shelf according to claim 5, wherein an end of the transmission shaft is provided with a second through hole, the locking member is inserted in the second through hole, and the limiting member comprises a limiting step provided on the transmission shaft.

7. The shelf according to claim 1, wherein the plate body comprises a first plate body and a second plate body detachably connected to each other, the second plate body is arranged at a first side of the first plate body, and the accommodation cavity and the arc groove are arranged at a side of the second plate body facing the first plate body; and the mounting portion comprises a groove arranged at a position where an outer surface of the first plate body is connected to an outer surface of the second plate body, or arranged at the outer surface of the second plate body.

8. The shelf according to claim 1, wherein the lifting storage-board assembly comprises a shelf body and a guiding member, the guiding member comprises a linear guiding rail and a slider, the slider is slidingly matched with a corresponding linear guiding rail and is connected to a second end of a corresponding flexible cable, and the shelf body is connected to the slider.

9. The shelf according to claim 8, wherein the guiding member further comprises a connecting piece, and the slider is respectively connected to the shelf body and the second end of the corresponding flexible cable through the connecting piece.

10. The shelf according to claim 9, wherein the connecting piece is detachably connected to the second end of the corresponding flexible cable.

11. The shelf according to claim 9, wherein the connecting piece is provided with a hanging hook, and the hanging hook is hung on the second end of the corresponding flexible cable.

12. A shelf, comprising:

a lifting storage-board assembly;

a driving assembly, comprising a driving member and a transmission shaft, wherein the driving member is connected to the transmission shaft in a transmission manner; and a transmission assembly, comprising a plate body and a flexible cable, wherein the plate body is connected to the transmission shaft, the plate body comprises an accommodation cavity and an arc groove, a first end-opening of the arc groove is in communication with the accommodation cavity, and a second end-opening of the arc groove is in communication with an outside of the plate body, and a first end of the flexible cable passes through the arc groove to be fixed in the accommodation cavity, and a second end of the flexible cable is configured to wrap around a mounting portion of the plate body and then connect to the lifting storage-board assembly, wherein:

the plate body comprises a first plate body and a second plate body detachably connected to each other, the second plate body is arranged at a first side of the first plate body, and the accommodation cavity and the arc groove are arranged at a side of the second plate body facing the first plate body, and the mounting portion comprises a groove arranged at a position where an outer surface of the first plate body is connected to an outer surface of the second plate body, or arranged at the outer surface of the second plate body.

13. The shelf according to claim 12, wherein the plate body is provided with a first through hole in a thickness direction of the plate body, the first through hole is in communication with the accommodation cavity, and the transmission shaft is inserted into a corresponding first through hole.

14. The shelf according to claim 12, wherein the transmission shaft is provided with a limiting member and a locking member, the limiting member abuts against a first side of a corresponding plate body, and the locking member abuts against a second side of the corresponding plate body.

15. The shelf according to claim 12, comprising at least two driving assemblies, wherein two adjacent transmission shafts of the at least two driving assemblies are parallel and arranged at an interval, and a rotating shaft is parallel or perpendicular to the transmission shaft.

16. The shelf according to claim 12, wherein lengths of two adjacent transmission shafts are different, and the driving member is arranged between the two adjacent transmission shafts.

17. A storage cabinet, comprising a cabinet body, and a shelf, the shelf including:

a lifting storage-board assembly;

at least two driving assemblies, wherein each of the driving assemblies comprises a driving member and a transmission shaft connected to the driving member in a transmission manner, and two adjacent transmission shafts are arranged at an interval along a set direction and the two adjacent transmission shafts are staggered; and at least two transmission assemblies, wherein each of the transmission assemblies comprises a plate body and a flexible cable, the plate body is connected to a corresponding transmission shaft, a first end of the flexible cable is connected to the plate body, and a second end of the flexible cable is configured to wrap around a mounting portion of the plate body and then connect to the lifting storage-board assembly, wherein:

the lifting storage-board assembly comprises a shelf body and a guiding member, the guiding member comprises a linear guiding rail and a slider, the slider is slidingly matched with a corresponding linear guiding rail and is connected to a second end of a corresponding flexible cable, and the shelf body is connected to the slider, the guiding member further comprises a connecting piece, and the slider is respectively connected to the shelf body and the second end of the corresponding flexible cable through the connecting piece, and the connecting piece is provided with a hanging hook, and the hanging hook is hung on the second end of the corresponding flexible cable.

18. A shelf, comprising:

a lifting storage-board assembly;

at least two driving assemblies, wherein each of the at least two driving assemblies comprises a driving member and a transmission shaft connected to the driving member in a transmission manner, and two adjacent transmission shafts are arranged at an interval along a set direction and the two adjacent transmission shafts are staggered; and at least two transmission assemblies, wherein each of the transmission assemblies comprises a plate body and a flexible cable, the plate body is connected to a corresponding transmission shaft, a first end of the flexible cable is connected to the plate body, and a second end of the flexible cable is configured to wrap around a mounting portion of the plate body and then connect to a the lifting storage-board assembly, wherein:

a plate body of a transmission assembly of the at least two transmission assemblies comprises an accommodation cavity and an arc groove, a first end-opening of the arc groove is in communication with the accommodation cavity, and a second end-opening of the arc groove is in communication with an outside of the plate body, and the first end of the flexible cable of the transmission assembly passes through the arc groove to be fixed in the accommodation cavity, and the second end of the flexible cable is configured to wrap around the mounting portion of the plate body and then connect to the lifting storage-board assembly, the plate body comprises a first plate body and a second plate body detachably connected to each other, the second plate body is arranged at a first side of the first plate body, and the accommodation cavity and the arc groove are arranged at a side of the second plate body facing the first plate body, and the mounting portion comprises a groove arranged at a position where an outer surface of the first plate body is connected to an outer surface of the second plate body, or arranged at the outer surface of the second plate body.

19. The shelf according to claim 18, wherein lengths of the two adjacent transmission shafts are different, and a driving member of a driving assembly of the at least two driving assemblies is arranged between the two adjacent transmission shafts.

20. The shelf according to claim 18, wherein the two adjacent transmission shafts are parallel to one another, and a rotating shaft of a driving member of a driving assembly of the at least two driving assemblies is parallel or perpendicular to a transmission shaft of the driving assembly.

* * * * *